US005674426A

United States Patent [19]

Schmid et al.

[11] Patent Number: 5,674,426

[45] Date of Patent: Oct. 7, 1997

[54] DEVICE FOR CONTROLLING AN INFLOW OF METAL BY MEANS OF A STOPPER

[75] Inventors: Markus Schmid, Wädenswil; Hans Gloor, Umiken, both of Switzerland

[73] Assignee: Concast Standard AG, Zurich, Switzerland

[21] Appl. No.: 618,964

[22] Filed: Mar. 20, 1996

[30] Foreign Application Priority Data

Mar. 28, 1995 [CH] Switzerland ..... 00 870/95

[51] Int. Cl.[6] ..... B22D 41/20

[52] U.S. Cl. ..... 222/602; 164/450.2; 164/453

[58] Field of Search ..... 164/450.2, 453; 222/590, 602

[56] References Cited

U.S. PATENT DOCUMENTS 4,905,755 3/1990 Lothmann ..... 164/450.2
5,312,090 5/1994 Seaton et al. ..... 222/602

FOREIGN PATENT DOCUMENTS 0 444 297 A2 12/1990 European Pat. Off. .
4-270049 9/1992 Japan ..... 164/453

*Primary Examiner*—Joseph J. Hail, III
*Assistant Examiner*—I. -H. Lin
*Attorney, Agent, or Firm*—Darby & Darby

[57] ABSTRACT

In a device for controlling a flow of metal from a casting vessel into a casting mould, the inflow of metal is to be controlled by means of a stopper, which may be lifted and lowered according to a preset program and/or by means of a bath-level measuring device. In order to prevent any manual operation of a control lever for the stopper, a lifting rod for the stopper is disposed in a module box together with a vertical guide and a computer-controlled electromechanical drive for the lifting rod. The module box is exchangeably fastened to the casting vessel by clamping elements. Before casting begins, a drive motor for the stopper (13) is to be connected by means of electric plug-and-socket connections to a control cabinet. From the start of casting, the stopper movement is controllable exclusively by means of the electric drive.

25 Claims, 1 Drawing Sheet

DEVICE FOR CONTROLLING AN INFLOW OF METAL BY MEANS OF A STOPPER

BACKGROUND OF THE INVENTION

The invention relates to a device for controlling a flow of metal from a casting vessel into a casting mould.

In the field of casting metals, in particular steel, stopper control devices for ladles and continuous-flow vessels have been known for some time. With the introduction of continuous casting, new demands have been placed upon control of the flow of metal into continuous casting moulds. Precise observance of a preset bath level, an automatic start of casting, rapid reaction in the event of break-outs, etc. are problems for which in recent years many proposed solutions have been worked out.

All of the proposals for mechanizing and automating a stopper control device have been based on a safety concept which at the start of casting, in the event of a break-out, in the event of a mould overflowing, etc., provided for a rapid manual intervention at a lever device acting upon the lifting rod. As a drive for program-controlled movements of the lifting rod or the stopper rod, hydraulic control systems have proved successful in practice. Proposals for electric drives have, for various reasons, gained little acceptance in steel mills. The problems of uncontrolled wear of stoppers and discharge nozzles, a continuous variation in the basic closed position of the stopper during casting, maintaining a preset closing force between stopper and discharge nozzle, etc. are in practice solved in a satisfactory manner by means of hydraulic drives.

From EP publication 0 444 297 A2, a device is known for controlling a flow of metal from a casting vessel into a continuous casting mould for a steel strand. A stopper, which may be lifted and lowered, cooperates with a discharge nozzle. The stopper may be operated by means of a drive, e.g., a piston/cylinder unit, under normal conditions and manually by means of an articulated lever in an emergency. At the start of casting, the inflow of metal may be controlled according to a preset program by means of a computer and/or by means of a bath-level measuring device.

Besides computer-controlled casting programs, which may also include closure of the discharge nozzle in the event of a strand break-out, it is possible at any time to disconnect the hydraulic control system and, through intervention at the articulated lever, take over manual control of the casting operation both in the event of faults and in emergency situations. Such faults may be mould overflows, stopper and/or discharge nozzle wear, break-outs, $Al_2O_3$ deposits, etc.

Manual filling of the mould at the start of casting by means of an articulated lever prevents construction of a simple compact device.

SUMMARY OF THE INVENTION

The object of the invention is to provide a stopper control device which overcomes the drawbacks described above and in particular abandons the classic stopper-operating concept which provides for manual intervention at a stopper control lever at start-up or in emergency situations. The stopper control system is moreover to have a much higher control accuracy and control speed in order further to improve the strand quality. Also, for all types of faults which arise in practice, such as break-outs, stopper wear, nozzle erosion, $Al_2O_3$ deposits, etc., preset running programs are to be usable automatically or via remote control. The new stopper-operating concept is to cut labour costs during commissioning and servicing, but also during casting itself.

According to the invention, this object is achieved by incorporating a guide device and a motor for the stopper in a module box which is releasably connectible to the casting vessel.

With the device according to the invention, a manual stopper operation by means of the lever device is no longer possible. Each stopper movement is transmitted to a computer-controlled or remote-controlled electric drive. Impending faults are recognized in good time through acquisition of corresponding parameters and suitably corrected by means of preset programs. As a result of early recognition of impending faults the strand quality, in particular the strand surface, may be improved. Dispensing with all of the hydraulic drive and control elements simplifies both the commissioning of the installation and the maintenance of the stopper control device. It is also possible to reduce the number of casters and increase safety. Dispensing with the provision of an articulated lever also excludes all of the moments of inertia caused by the articulated lever.

For discharge control, the stoppers are generally capable of being lifted and lowered relative to the discharge nozzle. However, stoppers are also known which effect discharge control by means of a rotational movement. The guide device for a stopper which may be lifted and lowered comprise a lifting rod and a guide.

The device for controlling the inflow of metal may be attached to each casting vessel which is required to perform programmed or remote-controlled casting operations. In order to reduce the number of casters at a continuous casting installation, the device may be used for intermediate vessels in multi-strand installations. Such intermediate vessels have up to eight discharge nozzles, each with a stopper control device.

In order to reduce the pollution, wear and susceptibility to faults of the control device, it is additionally proposed that an air pressure above atmospheric be provided in the module box.

It is in principle possible to provide a cooling system, known from prior art, for the module box. An air pressure above atmospheric may advantageously be built up by means of an air circulation system, the air flowing as a cooling medium through the module box, the lifting rod and a stopper carrier arm. An added protection against heating of the module box is provided if, in the course of assembly, an open air gap is disposed between the wall of the casting vessel and the module box.

To enable maintenance and inspection work to be carried out in suitable workshops and to minimize the preparation time for the intermediate vessel, it is additionally proposed to dispose on the module box a device for suspension on the casting vessel and to provide quick-action clamping elements for a rigid fastening.

Precise throughflow control calls for a high lifting accuracy, a high rate of motion of the lifting rod and a minimum of movable parts between the lifting rod and the servomotor. To achieve this and at the same time provide a suitably long guide path for the lifting rod it is proposed to dispose the drive shaft of the motor in the module box parallel to the lifting rod and its guide and to transmit the rotation of the motor directly to a ball-and-screw spindle drive which in turn, transmits the rotation directly to the lifting rod. The control accuracy may be further increased when the vertical guide of the lifting rod comprises a longitudinally extending ball-bearing unit and has a length 50 to 80% of the intermediate vessel height (base - lid support).

In order to be able to move the stopper vertically during preparation of the intermediate vessel, a handwheel may be coupled to the spindle of the ball-and-screw spindle drive.

For moving the stopper automatically into closing position in the event of a power failure, pressurized accumulators, spring assemblies, etc. are known from prior art. Such devices incur additional capital and maintenance costs and are ill-suited to a modular solution. According to an advantageous embodiment, it is proposed to dispose a primary detector in the power supply for rapid detection of a power failure and to dispose in the electric drive supply capacitors having a capacitance sufficient for a program-controlled emergency closing movement of the stopper in event of a power failure.

For increased safety in the event of damage to refractory parts, or faults in the computer, etc., an emergency slide with a sealing block may be associated with the discharge nozzle.

There follows an additional description of the invention with reference to drawings.

DESCRIPTION OF THE PREFERRED EMBODIMENTS

Figure 1:
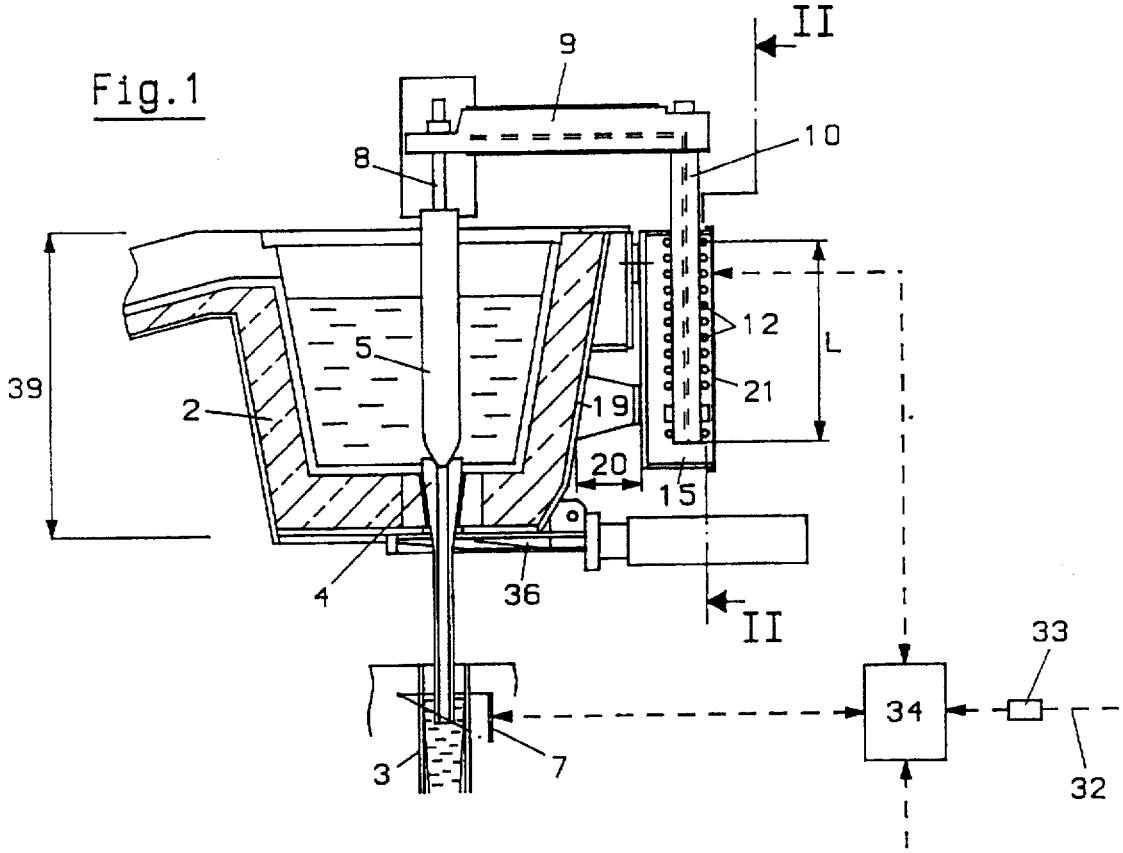
FIG. 1 a vertical section through an intermediate vessel with a stopper control device and FIG. 2 a slightly enlarged section according to the line II—II of FIG. 1.
Figure 2:
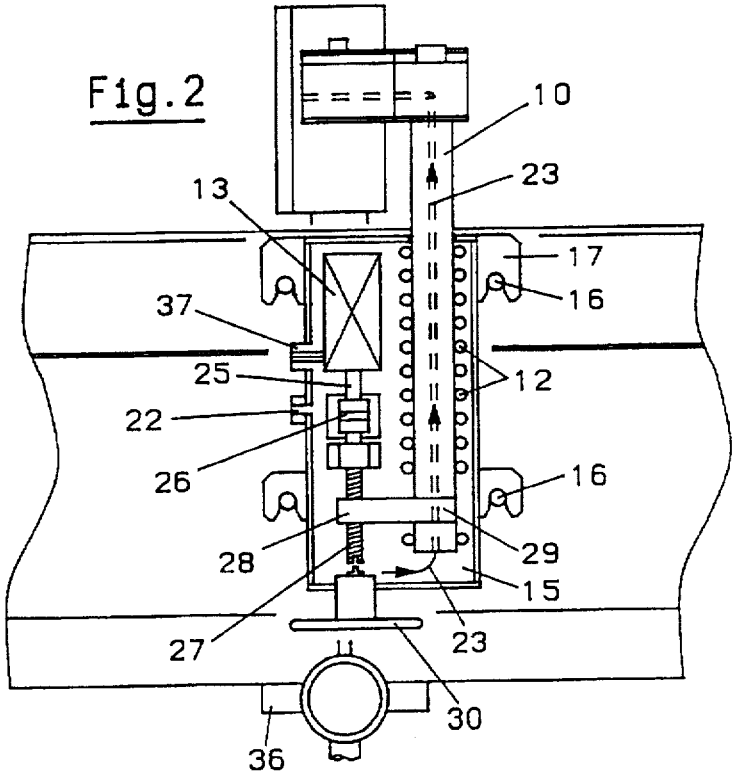

In FIGS. 1 and 2, a casting vessel is shown in the form of an intermediate vessel 2 within a continuous steel casting installation. A continuous casting mould 3 represents a casting mould. A discharge nozzle 4 cooperates with a stopper or closure 5 which may be lifted and lowered and controls the flow of steel from the intermediate vessel 2 into the continuous casting mould 3. The flow of steel into the mould 3 is controlled in accordance with a preset program, e.g. a start of casting program, and/or in accordance with a bath-level measuring device 7. The refractory stopper 5 encases the stopper rod 8, which is connected by an arm 9 to a lifting rod 10. The lifting rod 10 is disposed in a vertical guide 12 which, in the present example, comprises a longitudinal extending ball-bearing unit consisting of a series of superimposed ball bearings. A computer-controlled electromechanical drive in the form of a servomotor 13 is disposed, together with the lifting rod 10 and its vertical guide 12, in a module box or container 15. The module box 15 is exchangeably fastened to the intermediate vessel 2 by means of clamping elements 16. To guarantee ease of exchange, suspension devices 17 are provided on the module box 15. The clamping elements 16 take the form of quick-action clamping and centering elements. Disposed between the wall 19 of the intermediate vessel 2 and the module box 15 is an open air gap 20. The vertical guide 12 has a length L which can be 50 to 80%, and is preferably 70 to 80%, of the height 39 of the intermediate vessel 2, i.e., of the distance from the base to the lid support of the intermediate vessel 2.

The module box 15 is closed in a dustproof manner by a lid 21 and an air pressure above atmospheric may be built up by means of a compressed-air supply 22. The compressed-air supply 22 causes air to circulate through an air circulation system 23 which is illustrated by arrows. The air circulation system 23, which passes through the module box 15 serves to cool the motor 13, a ball-and-screw spindle drive 27, 28, the lifting rod 10 and the stopper carrier arm 9.

A drive shaft 25 of the motor 13 is connected by a coupling 26 to the ball-and-screw spindle 27. The spindle 27 together with a nut 28 forms a ball-and-screw spindle drive, and the nut 28 and lifting rod 10 are rigidly connected to one another by a bridge 29. Via the bridge 29, the displacement of the nut 28 is transmitted directly to the lifting rod 10. The drive shaft 25 and the spindle 27 are disposed in the module box 15 parallel to and at a slight distance from the lifting rod 10.

Disposed at the bottom end of the module box 15 is a handwheel 30, which may be coupled to the spindle 27 and allows a vertical adjustment of the lifting rod 10 when the electric connection cable to the motor is unplugged. After the intermediate vessel 2 has been shifted into the casting position, the module box 15 is electrically connected to the control cabinet 34 and the handwheel 30 is uncoupled from the spindle.

Connected in the power supply 32 for the motor 13 is a primary detector 33 which can detect a power failure and supply a corresponding signal to a computer in the control cabinet 34. Furthermore, disposed in the power supply are capacitors having a capacitance sufficient for a program-controlled emergency closing movement of the stopper in the event of a power failure.

A stopper control device is also subject to problems of a refractory nature, such as refractory parts breaking off from the stopper, fracture or erosion of the discharge nozzle, etc. In order to prevent a discharge from the intermediate vessel, independently of the stopper control system, in an emergency situation, an emergency slide or closure 36 controlled by a pneumatic piston/cylinder unit is provided at the bottom of the intermediate vessel. By means of a sealing block of the emergency slide 36, the discharge nozzle 4 may be closed and, if necessary, a casting pipe cut off at the same time. The medium for operating the piston/cylinder unit of the emergency slide is supplied by an accumulator.

Intermediate vessels for continuous casting installations are provided up to eight stoppers, with each of which can be provided with a separate module box and control system. When the intermediate vessel is moved from the preheating position into the casting position above the moulds or into a filing position close to the casting position, the stopper drive motor is connected, by means of electric plug-and-socket connections 37, to the control cabinet 34 before casting begins. After connection, the stopper movement is controlled exclusively by electric signals. For remote control, all previously known transmission means, such as wires, optical fibres, radio, infrared, etc., may be used.

We claim:

1. A device for controlling a closure of a casting vessel, comprising a container, said container being provided with connecting means for releasably connecting said container to the casting vessel; guide means for said closure disposed in said container; and an electrical drive for said closure disposed in said container, said drive being provided with means for plugging said drive into a source of electrical control signals.

2. The device of claim 1, wherein said guide means comprises a guide member defining a guide passage, and a rod receivable in said guide passage.

3. The device of claim 1, further comprising means for pressurizing said container.

4. The device of claim 3, wherein said pressurizing means comprises means for admitting cooling air into said container.

5. The device of claim 4, wherein said guide means defines a flow passage for the cooling air.

6. The device of claim 1, wherein said connecting means comprises means for suspending said container on the casting vessel.

7. The device of claim 1, wherein said guide means comprises a guide member defining a guide passage, and a rod receivable in said guide passage, said drive including a drive shaft which is substantially parallel to said rod; and further comprising means for transmitting force between said shaft and said rod, said transmitting means comprising a screw.

8. The device of claim 7, further comprising a handwheel which is releasably connectible to said screw.

9. A casting installation, comprising a casting vessel having at least one outlet; at least one closure for said one outlet; an electrical power supply including a source of electrical control signals; and at least one device for controlling said closure, said device comprising a container provided with connecting means for releasably connecting said container to said casting vessel, guide means for said closure disposed in said container, and an electrical drive for said closure disposed in said container, said source and said drive being provided with complementary plugs and sockets for electrically coupling said source and said drive to one another.

10. The installation of claim 9, wherein said guide means comprises a guide member defining a guide passage, and a rod receivable in said guide passage.

11. The installation of claim 9, wherein said casting vessel has a plurality of outlets and a closure is provided for each of said outlets, each of said closures being controlled by a respective device similar or identical to said one device.

12. The installation of claim 11, wherein said casting vessel has 2 to 8 outlets.

13. The installation of claim 9, further comprising means for pressurizing said container.

14. The installation of claim 13, wherein said pressurizing means comprises means for admitting cooling air into said container.

15. The installation of claim 9, wherein said guide means comprises a guide member defining a guide passage, and a rod receivable in said guide passage; and further comprising a carrier arm for said one closure and said rod, said rod and said carrier arm defining a flow passage for the cooling air.

16. The installation of claim 9, wherein said connecting means is designed to connect said container to said vessel with an air gap between said container and said vessel.

17. The installation of claim 9, wherein said connecting means comprises means for suspending said container on said vessel.

18. The installation of claim 9, wherein said guide means comprises a guide member defining a guide passage, and a rod receivable in said guide passage, said drive including a drive shaft which is substantially parallel to said rod; and further comprising means for transmitting force between said shaft and said rod, said transmitting means comprising a screw.

19. The installation of claim 18, further comprising a handwheel which is releasably connectible to said screw.

20. The installation of claim 9, wherein said power supply comprises a detector for power failures.

21. The installation of claim 9, wherein said one closure has an open position and a closed position, said power supply comprising sufficient capacitance to move said one closure from said open position to said closed position when said one closure is in said open position upon occurrence of a power failure.

22. The installation of claim 9, wherein said vessel has a predetermined height, said guide means comprising a substantially vertical guide member deeming a guide passage, and a receivable in said guide passage, said guide member including a plurality of superimposed ball bearings and having a length of about 50 to about 80 percent of said predetermined height.

23. The installation of claim 22, wherein said length is about 70 to about 80 percent of said predetermined height.

24. The installation of claim 9, wherein said one closure comprises a stopper rod; and further comprising an additional closure for said one outlet, said additional closure including a slide provided with a sealing block.

25. The installation of claim 24, further comprising drive means for said slide, said drive means including a piston-and-cylinder unit and a source of pressurized fluid for said unit.

* * * * *

UNITED STATES PATENT AND TRADEMARK OFFICE

CERTIFICATE OF CORRECTION

PATENT NO. : 5,674,426

DATED : October 7, 1997

INVENTOR(S) : Markus SCHMID and Hans GLOOR

It is certified that error appears in the above-identified patent and that said Letters Patent is hereby corrected as shown below:

On the title page, item: [30], Foreign Application Priority Data, change "00 870/95" to --00 870/95-7--.

Signed and Sealed this

Thirtieth Day of December, 1997

*Attest:*

*Attesting Officer*

Bruce Lehman

BRUCE LEHMAN

*Commissioner of Patents and Trademarks*